US007913655B2

(12) United States Patent
Sugie et al.

(10) Patent No.: US 7,913,655 B2
(45) Date of Patent: Mar. 29, 2011

(54) ELECTROMAGNETICALLY-DRIVEN VALVE

(75) Inventors: Yutaka Sugie, Toyota (JP); Masahiko Asano, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 376 days.

(21) Appl. No.: 12/155,607

(22) Filed: Jun. 6, 2008

(65) Prior Publication Data

US 2008/0314341 A1 Dec. 25, 2008

(30) Foreign Application Priority Data

Jun. 7, 2007 (JP) ..... 2007-151528

(51) Int. Cl.
*F01L 9/04* (2006.01)

(52) U.S. Cl. ..... 123/90.11; 123/90.22; 251/129.16

(58) Field of Classification Search ..... 123/90.11, 123/90.15, 90.22, 90.4, 90.23, 188.2; 251/129.16
See application file for complete search history.

(56) References Cited

U.S. PATENT DOCUMENTS

| | | | | |
|---|---|---|---|---|
| 6,467,441 | B2 | 10/2002 | Cristiani et al. | |
| 6,481,396 | B2 | 11/2002 | Stolk et al. | |
| 6,516,758 | B1 * | 2/2003 | Leiber | 123/90.11 |
| 6,571,823 | B2 | 6/2003 | Rossi et al. | |
| 7,088,209 | B2 | 8/2006 | Keck | |
| 7,418,932 | B2 * | 9/2008 | Sugie et al. | 123/90.11 |
| 2004/0055549 | A1 * | 3/2004 | Petrie | 123/90.16 |
| 2006/0260572 | A1 | 11/2006 | Sugie et al. | |
| 2009/0114863 | A1 * | 5/2009 | Nishida | 251/129.15 |

FOREIGN PATENT DOCUMENTS

| | | | |
|---|---|---|---|
| DE | 100 25 491 | | 12/2001 |
| JP | 2007-023889 | A | 2/2007 |
| JP | 2007-032436 | A | 2/2007 |
| JP | 2007-040238 | A | 2/2007 |

* cited by examiner

*Primary Examiner* — Thomas E Denion
*Assistant Examiner* — Daniel A Bernstein
(74) *Attorney, Agent, or Firm* — Kenyon & Kenyon LLP

(57) ABSTRACT

An electromagnetically-driven valve includes intake valves that are provided in a gasoline engine and that are arranged side by side; a valve plate that connects the intake valves to each other, wherein driving force that is generated by electromagnetic force is transferred to the valve plate; and a changing mechanism that is fitted to the valve plate. The changing mechanism changes the valve drive state between the two-valve drive state, in which both of the intake valves are driven, and the one-valve drive state, in which one of the intake valves is driven and the other intake valve is stopped.

6 Claims, 8 Drawing Sheets

ELECTROMAGNETICALLY-DRIVEN VALVE

INCORPORATION BY REFERENCE

The disclosure of Japanese Patent Application No. 2007-151528 filed on Jun. 7, 2007 including the specification, drawings and abstract is incorporated herein by reference in its entirety.

BACKGROUND OF THE INVENTION

1. Field of the Invention

The invention relates generally to an electromagnetically-driven valve, and more specifically to an electromagnetically-driven valve that collectively opens and closes multiple valves provided in an internal combustion engine.

2. Description of the Related Art

For example, the specification of U.S. Pat. No. 6,467,441 describes art related to an existing electromagnetically-driven valve, more specifically, an electromagnetic actuator that actuates a valve of an internal combustion engine using electromagnetic force and elastic force of a spring in combination. The electromagnetic actuator described in the specification of U.S. Pat. No. 6,467,441 includes a valve that has a stem, and a pivot arm. The pivot arm has a first end portion that is pivotally supported by a support frame, and a second end portion that contacts a tip of the stem. Electromagnets each include a core and a coil wound around the core, and are arranged above and below the pivot arm.

The electromagnetic actuator further includes a torsion bar that is fitted to the first end portion of the pivot arm and that applies force to the valve to open the valve, and a spiral spring that is arranged around the outer periphery of the stem and that applies force to the valve to close the valve. The pivot arm is alternately attracted to the cores of the electromagnets arranged above and below the pivot arm on the basis of the elastic force of the torsion bar and the elastic force of the spiral spring.

Electromagnetically-driven valves that are structured in a fashion similar to that described above are described in Japanese Patent Application Publication No. 2007-23889 (JP-A-2007-23889), Japanese Patent Application Publication No. 2007-32436 (JP-A-2007-32436), the specification of German Patent Laid-Open Publication No. 10025491, the specification of U.S. Pat. No. 7,088,209, the specification of U.S. Pat. No. 6,571,823, and the specification of U.S. Pat. No. 6,481,396.

A structure in which two valves of an engine are collectively driven using the electromagnetically-driven valve described in each of the above documents may be employed. However, when the engine is operating at low speed or low load, a sufficient amount of air may be introduced into the engine or a sufficient amount of exhaust gas may be discharged from the engine by driving only one valve. If two valves are kept driving in such a case, the electromagnetically-driven valve may consume unnecessarily large amount of electric power.

SUMMARY OF THE INVENTION

The invention provides an electromagnetically-driven valve that consumes less amount of electric power.

An aspect of the invention relates to an electromagnetically-driven valve, that includes: a first valve and a second valve that are provided in an internal combustion engine, and that are arranged side by side; a connection member which connects the first valve with the second valve, wherein driving force that is generated by electromagnetic force is transferred to the connection member; and a changing mechanism that is fitted to the connection member. The changing mechanism changes the valve drive state between the first state, in which the first valve and the second valve are both driven, and the second state, in which the first valve is driven and the second valve is stopped.

In the thus structured electromagnetically-driven valve, the drive state of the first valve and the second valve is changed between the first state and the second state based on the operating state of the internal combustion engine. Thus, it is possible to stop the second valve when a proper operation of the internal combustion engine is ensured by driving only the first valve. As a result, the amount of electric power that is consumed by the electromagnetically-driven valve is reduced.

In the first aspect of the invention, the connection member may include a first connection portion that is connected to the first valve and a second connection portion that is connected to the second valve. In addition, the changing mechanism may include an actuator that actuates the connection member. When the changing mechanism changes the valve drive state from the first state to the second state, the actuator may cause the connection member to pivot about the first connection portion to thereby disconnect the second valve from the second connection portion. In the thus structured electromagnetically-driven valve, it is possible to change the valve drive state of the first valve and the second valve between the first state and the second state by actuating the connection member using the actuator.

In the first aspect of the invention, the connection member may include a support portion that movably supports the second valve. In addition, the changing mechanism may include a fixing member that fixes the second valve to the support portion, and an actuator that actuates the fixing member. When the changing mechanism changes the valve drive state from the first state to the second state, the actuator may actuate the fixing member to cancel fixation of the second valve to the support portion by the fixing member to thereby allow the support portion to move relative to the second valve. In the thus structured electromagnetically-driven valve, it is possible to change the valve drive state of the first valve and the second valve between the first state and the second state by actuating the fixing member using the actuator.

In the first aspect of the invention, the connection member may include a support portion that movably supports the second valve. In addition, the changing mechanism may include a hydraulic mechanism that applies hydraulic pressure to the second valve to fix the second valve to the support portion. When the changing mechanism changes the valve drive state from the first state to the second state, fixation of the second valve to the support portion by the hydraulic mechanism may be cancelled to thereby allow the support portion to move relative to the second valve. In the thus structured electromagnetically-driven valve, it is possible to change the valve drive state of the first valve and the second valve between the first state and the second state by applying the hydraulic pressure to the second valve using the hydraulic mechanism or stopping the application of the hydraulic pressure to the second valve.

In the first aspect of the invention, the hydraulic mechanism may include a hydraulic pressure control unit that controls a degree of hydraulic pressure that is applied to the second valve. In the thus structured electromagnetically-driven valve, it is possible to adjust the relative position between the second valve and the connection member by controlling the degree of hydraulic pressure. Thus, it is possible to adjust the distance traveled by the second valve, that is, the valve lift amount.

As described above, the invention provides the electromagnetically-driven valve that consumes less amount of electric power.

BRIEF DESCRIPTION OF THE DRAWINGS

The foregoing and further features and advantages of the invention will become apparent from the following description of example embodiments with reference to the accompanying drawings, wherein the same or corresponding portions will be denoted by the same reference numerals and wherein.

DETAILED DESCRIPTION OF THE EXAMPLE EMBODIMENTS

Figure 1:
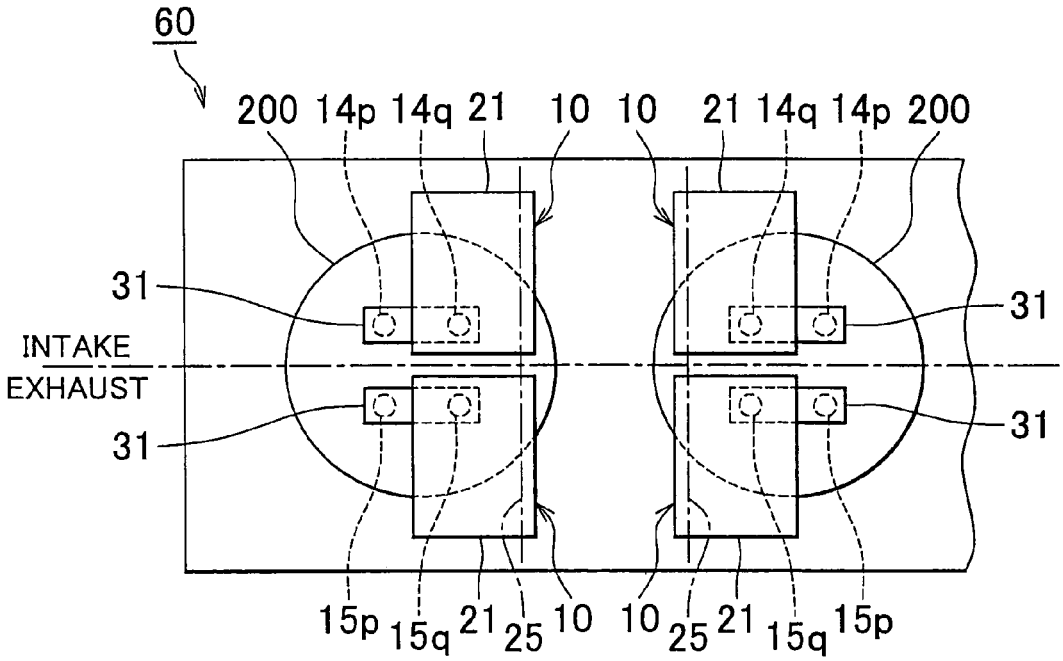
FIG. 1 is a plane view showing a gasoline engine that is provided with electromagnetically-driven valves according to a first embodiment of the invention.

Hereafter, embodiments of the invention will be described with reference to the accompanying drawings. Note that, the same or corresponding portions will be denoted by the same reference numerals in the drawings.

First Embodiment of the Invention

FIG. 1 is a plane view showing a gasoline engine provided with electromagnetically-driven valves according to a first embodiment of the invention. As shown in FIG. 1, electromagnetically-driven valves 10 are provided in a gasoline engine 60 that is an internal combustion engine. The gasoline engine 60 includes a plurality of cylinders 200. The cylinders 200 are aligned in one direction with predetermined intervals. The gasoline engine 60 is an in-line multi-cylinder engine.

The type of an internal combustion engine in which the electromagnetically-driven valve 10 is provided is not particularly limited. For example, the electromagnetically-driven valve 10 may be provided in a diesel engine. The internal combustion engine may be a single-cylinder engine. The layout of the cylinders 200 is not particularly limited. The electromagnetically-driven valve 10 may be provided in, for example, a V engine, a horizontally opposed engine, or a W engine.

Each cylinder of the gasoline engine 60 is provided with intake valves 14*p* and 14*q* and exhaust valves 15*p* and 15*q*. At each cylinder, the intake valve 14*p* and the intake valve 14*q* are arranged side by side, and the exhaust valve 15*p* and the exhaust valve 15*q* are arranged side by side. The electromagnetically-driven valve 10 collectively opens or closes the intake valve 14*p* and the intake valve 14*q* of each cylinder of the gasoline engine 60. Similarly, the electromagnetically-driven valve 10 collectively opens or closes the exhaust valve 15*p* and the exhaust valve 15*q* of each cylinder of the gasoline engine 60.

The electromagnetically-driven valve 10 may be structured so as to collectively open or close three or more intake valves or exhaust valves.

Figure 2:
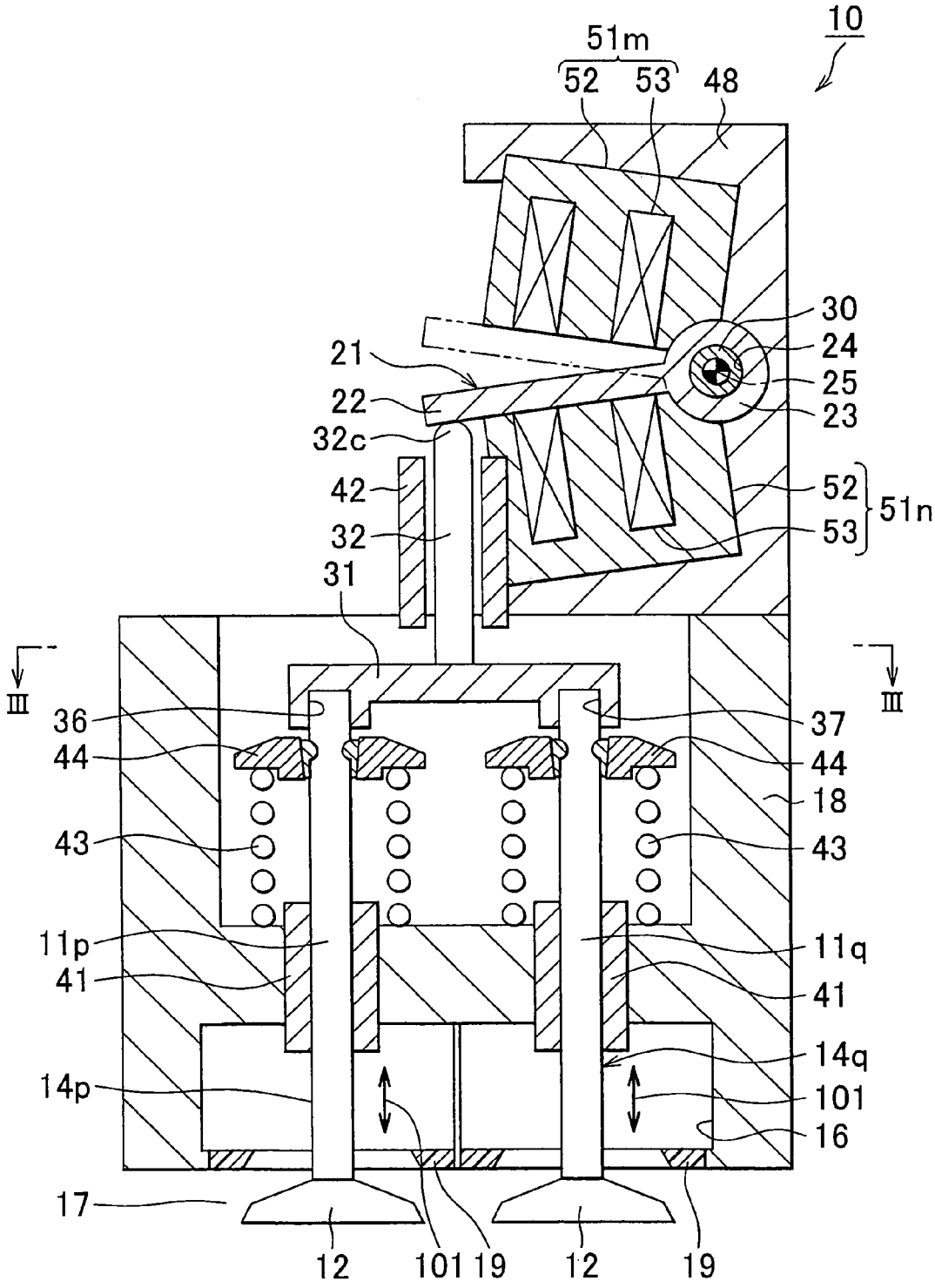
FIG. 2 is a cross-sectional view showing the electromagnetically-driven valve according to the first embodiment of the invention.

FIG. 2 is a cross-sectional view showing the electromagnetically-driven valve according to the first embodiment of the invention. Hereafter, the electromagnetically-driven valve 10 that collectively opens or closes the intake valve 14*p* and the intake valve 14*q* will be described. Note that, the electromagnetically-driven valve 10 that collectively opens or closes the exhaust valve 15*p* and the exhaust valve 15*q* have the same structure.

As shown in FIGS. 1 and 2, each electromagnetically-driven valve 10 is a pivot-type electromagnetically-driven valve that is driven by combination of electromagnetic force and elastic force. The electromagnetically-driven valve 10 includes the intake valves 14*p* and 14*q*, a disk 21 that pivots about a central axis 25, which is a virtual axis, and electromagnets 51*m* and 51*n* that apply electromagnetic force to the disk 21.

The intake valve 14*p* and the intake valve 14*q* include a stem 11*p* and a stem 11*q*, respectively. The stem 11*p* and the stem 11*q* extend in parallel to each other. The intake valve 14*p* and the intake valve 14*q* reciprocate in the direction in which the stems 11*p* and 11*q* extend (direction shown by arrows 101) in accordance with the pivot motion of the disk 21.

The intake valves 14*p* and 14*q* are provided in a cylinder head 18. Intake ports 16 are formed within the cylinder head 18. Valve seats 19 are provided at positions at which the intake ports 16 are communicated with a combustion chamber 17. The intake valve 14*p* and the intake valve 14*q* include bell portions 12 that are fitted to the tips of the stem 11*p* and the stem 11*q*. In accordance with the reciprocation of the intake valves 14*p* and 14*q*, the bell portions 12 contact the valve seats 19 or move away from the valve seats 19, whereby the intake ports 16 close or open.

The electromagnetically-driven valve 10 includes a valve plate 31 and an intermediate stem 32. The valve plate 31 extends from the intake valve 14*p* toward the intake valve 14*q*. The valve plate 31 connects the intake valve 14*p* and the intake valve 14*q* with each other. The valve plate 31 transfers the driving force generated by the electromagnetic force to the intake valves 14*p* and 14*q*. The intermediate stem 32 connects the disk 21 and the valve plate 31 to each other. The driving force generated by the electromagnetic force is transferred from the disk 21 to the valve plate 31 through the intermediate stem 32.

The electromagnetically-driven valve 10 includes guide members 41 that guide the stems 11*p* and 11*q* so that the stems 11*p* and 11*q* slide in their axial direction. The electromagnetically-driven valve 10 includes a guide member 42 that guides the intermediate stem 32 so that the intermediate stem 32 slides in its axial direction. The guide members 41 and the guide member 42 are made of metal, for example, stainless, so that these guide members endure high-speed slide over the stems.

Lower springs 43, which serve as first spring members, are supported on the peripheries of the stems 11*p* and 11*q* by lower retainers 44 having a brimmed shape. The lower springs 43 are formed of coil springs. The lower springs 43 apply elastic forces for moving the stems 11*p* and 11*q* upward to the intake valves 14*p* and 14*q*.

A support base 48 is fixed onto the top face of the cylinder head 18. The support base 48 supports the electromagnets 51*m* and 51*n*. The electromagnet 51*m* is arranged above the disk 21, and the electromagnet 51*n* is arranged below the disk 21.

The electromagnet 51*m* and the electromagnet 51*n* are the same in shape. The shape of the electromagnet 51*n* will be described below. The electromagnet 51*n* includes a coil 53 and a core 52. The coil 53 is wound around the core 52.

The core 52 is made of magnetic material. In the first embodiment of the invention, the core 52 is formed of multiple electromagnetic steel plates that are stacked on top of each other. The core 52 may be made of magnetic material other than electromagnetic steel plates, for example, a green compact made of magnetic power. The coil 53 of the electromagnet 51*m* and the coil 53 of the electromagnet 5 in may be made of a continuous single coil wire, or made of separate coil wires.

The support base 48 supports the disk 21. The disk 21 is made of magnetic material. The disk 21 is formed of a bulk material to maintain a sufficient level of strength. The disk 21 includes a support portion 23 and a connection portion 22. The central axis 25 is defined in the support portion 23. The disk 21 extends from the support portion 23 toward the connection portion 22 in the direction that intersects with the stems 11*p* and 11*q*.

A through-hole 24 is formed in the support portion 23. A torsion bar 30, which serves as a second spring member, is press-fitted into the through-hole 24. The torsion bar 30 extends in the axial direction of the central axis 25. The support portion 23 is pivotally supported by the support base 48 via the torsion bar 30. When a tip 32*c* of the intermediate stem 32 contacts the connection portion 22, the intermediate stem 32 and the disk 21 are connected to each other.

The torsion bar 30 applies elastic force for causing the disk 21 to pivot counterclockwise about the central axis 25 to the disk 21. That is, the torsion bar 30 applies elastic force for moving the stems 11*p* and *l* q downward to the intake valves 14*p* and 14*q* via the valve plate 31. When the electromagnetic force is not applied to the disk 21, the disk 21 is kept at the middle portion between the valve-open position and the valve-closed position due to the elastic forces of the lower spring 43 and the torsion bar 30.

When an electric current is supplied to the coil 53 of the electromagnet 51*m*, a magnetic flux flow is formed so as to pass through the core 52 of the electromagnet 51*m* and the disk 21. Thus, the electromagnet 51*m* generates electromagnetic force that attracts the disk 21 to the electromagnet 51*m*. When an electric current is supplied to the coil 53 of the electromagnet 5 in, a magnetic flux flow is formed so as to pass through the core 52 of the electromagnet 51*n* and the disk 21. Thus, the electromagnet 5 in generates electromagnetic force that attracts the disk 21 to the electromagnet 51*n*.

The disk 21 is attracted alternately to the electromagnet 51*m* and the electromagnet 51*n* by the electromagnetic force generated by the electromagnet 51*m* and the elastic force of the lower spring 43, and the electromagnetic force generated by the electromagnet 51*n* and the elastic force of the torsion bar 30. As a result, the disk 21 pivots about the central axis 25. When the disk 21 is attracted to the electromagnet 51*m*, the stems 11*p* and 11*q* move upward, and the intake valves 14*p* and 14*q* are brought to the valve-closed positions. When the disk 21 is attracted to the electromagnet 51*n*, the steps 11*p* and 11*q* move downward, and the intake valves 14*p* and 14*q* are brought to the valve-open positions.

Figure 3:
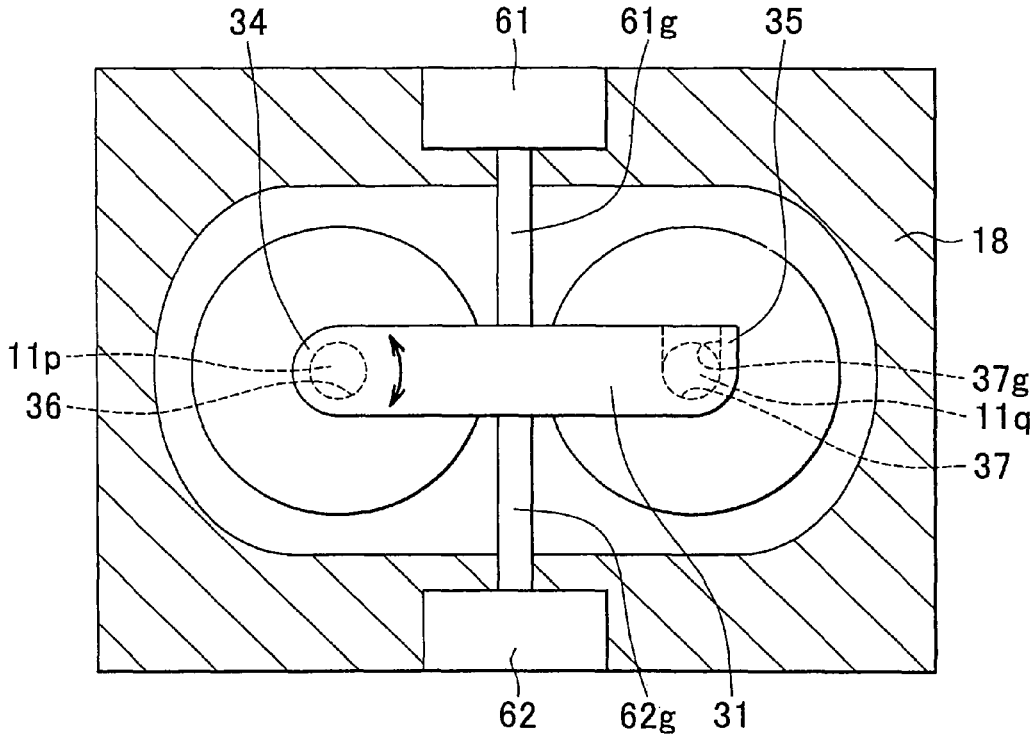
FIG. 3 is a cross-sectional view showing the electromagnetically-driven valve, taken along the line III-III in FIG. 2.
Figure 4:
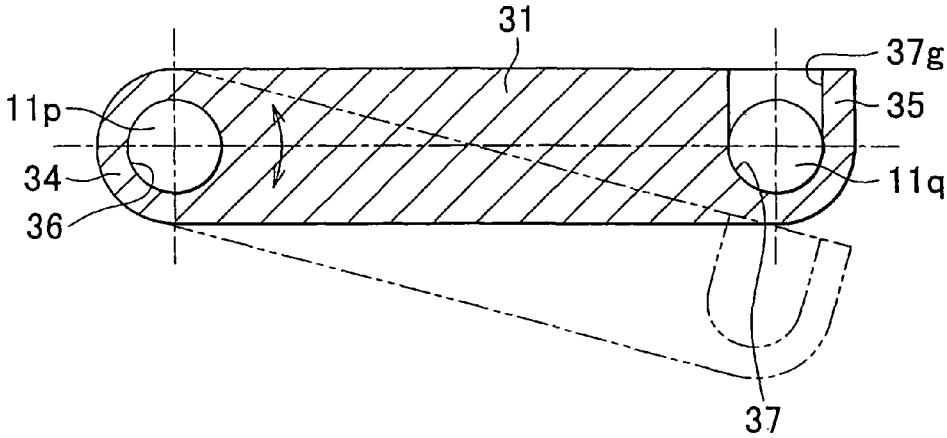
FIG. 4 is a cross-sectional view showing an operating state of a valve plate in FIG. 3.

FIG. 3 is a cross-sectional view of the electromagnetically-driven valve, taken along the line III-III in FIG. 2. FIG. 4 is a cross-sectional view showing an operating state of the valve plate in FIG. 3.

As shown in FIGS. 2 to 4, the valve plate 31 includes a connection portion 34, which serves as a first connection portion, and a connection portion 35, which serves as a second connection portion. The intake valve 14*p* and the intake valve 14*q* are connected to the connection portion 34 and the connection portion 35, respectively. A hole 36 and a hole 37 are formed in the connection portion 34 and the connection portion 35, respectively. The stem 11*p* of the intake valve 14*p* and the stem 11*q* of the intake valve 14*c* are fitted into the hole 36 and the hole 37, respectively.

A cutout portion 37*g* is formed in the connection portion 35. The cutout portion 37*g* is formed in such a manner that the periphery of the hole 37 is partially open. The width of the cutout portion 37*g* is larger than the diameter of the stem 11*q*. The entire periphery of the hole 36 is closed.

The electromagnetically-driven valve 10 includes hydraulic cylinders 61 and 62 which serve as actuators. The hydraulic cylinder 61 and the hydraulic cylinder 62 are provided with an arm 61*g* and an arm 62*g*, respectively. The hydraulic cylinder 61 and the hydraulic cylinder 62 are arranged on the respective sides of the valve plate 31. The arm 61*g* and the arm 62*g* contact the valve plate 31, at the positions between the connection portion 34 and the connection portion 35.

The hydraulic cylinders 61 and 62 change the valve drive state between a two-valve drive state in which the intake valve 14*p* and the intake valve 14*q* are both driven, and a one-valve drive state in which the intake valve 14*p* is driven and the intake valve 14*q* is stopped.

More specifically, when hydraulic pressure is supplied to the hydraulic cylinder 61, the arm 61*g* pushes the valve plate 31. At this time, the valve plate 31 pivots about the connection portion 34, whereby the stem 11*q* moves out of the hole 37 through the cutout portion 37. Thus, the connection portion 35 and the intake valve 14*q* are disconnected from each other. The intake valve 14*q* that is free from the pivot motion of the disk 21 is kept at the valve-closed position due to the elastic force of the coil spring 43. As a result, the electromagnetically-driven valve 10 is placed in the one-valve drive state in which only the intake valve 14*p* is driven.

When hydraulic pressure is supplied to the hydraulic cylinder 62, the arm 62*g* pushes the valve plate 31. At this time, the valve plate 31 pivots in the direction opposite to the direction described above. As a result, the stem 11*q* is fitted into the hole 37 through the cutout portion 37*g*. Thus, the connection portion 35 and the intake valve 14*q* are connected to each other. As a result, the electromagnetically-driven valve 10 is placed in the two-valve drive state in which the intake valve 14*p* and the intake valve 14*q* are both driven.

Note that, devices other than the hydraulic cylinders may be used as the actuators that drive the valve plate 31. For example, air cylinders or an electric motor may be used as the actuator.

The electromagnetically-driven valve 10 according to the first embodiment of the invention is provided in the gasoline engine 60 which is an internal combustion engine. The electromagnetically-driven valve 10 includes: the intake valve 14*p* and the intake valve 14*q* that are arranged side by side, and that serve as a first valve and a second valve, respectively; the valve plate 31 that connects the intake valve 14*p* and the intake valve 14*q* to each other, and that serves as a connection member to which the driving force generated by the electromagnetic force is transferred; and the hydraulic cylinders 61 and 62, which serve as changing mechanism, fitted to the valve plate 31. The hydraulic cylinders 61 and 62 change the valve drive state between the first state in which the intake valve 14*p* and the intake valve 14*q* are both driven and the second state in which the intake valve 14*p* is driven and the intake valve 14*q* is stopped.

With the thus structured electromagnetically-driven valve 10 according to the first embodiment of the invention, a sufficient amount of air is taken in the cylinder by opening one of the intake valve 14*p* and the intake valve 14*q*, for example, when the gasoline engine 60 is operating at low speed or low load. According to the first embodiment of the invention, in such a case, the valve drive state is changed from the two-valve drive state to the one-valve drive state in which only the intake valve 14*p* is driven. Thus, it is possible to minimize the electromagnetic force that is required to drive the valve, thereby reducing the electric power consumed by the electromagnetically-driven valve 10. In addition, it is possible to make the relative displacement between the valve plate 31 and the intermediate stem 32 substantially equal to zero when the valve is driven, because the changing mechanism is fitted to the valve plate 31.

Second Embodiment of the Invention

Figure 5:
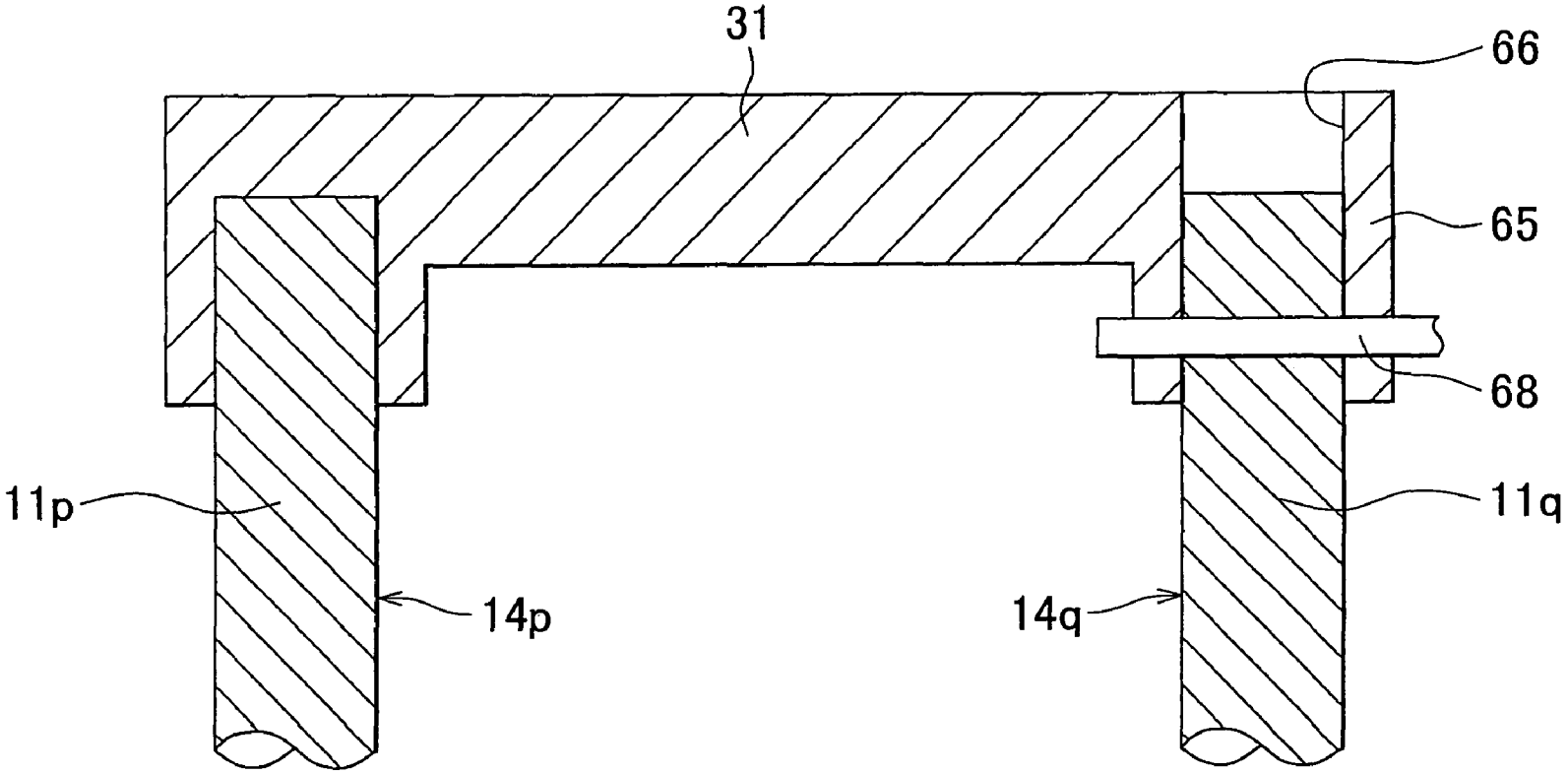
FIG. 5 is a cross-sectional view showing an electromagnetically-driven valve according to a second embodiment of the invention.
Figure 6B:
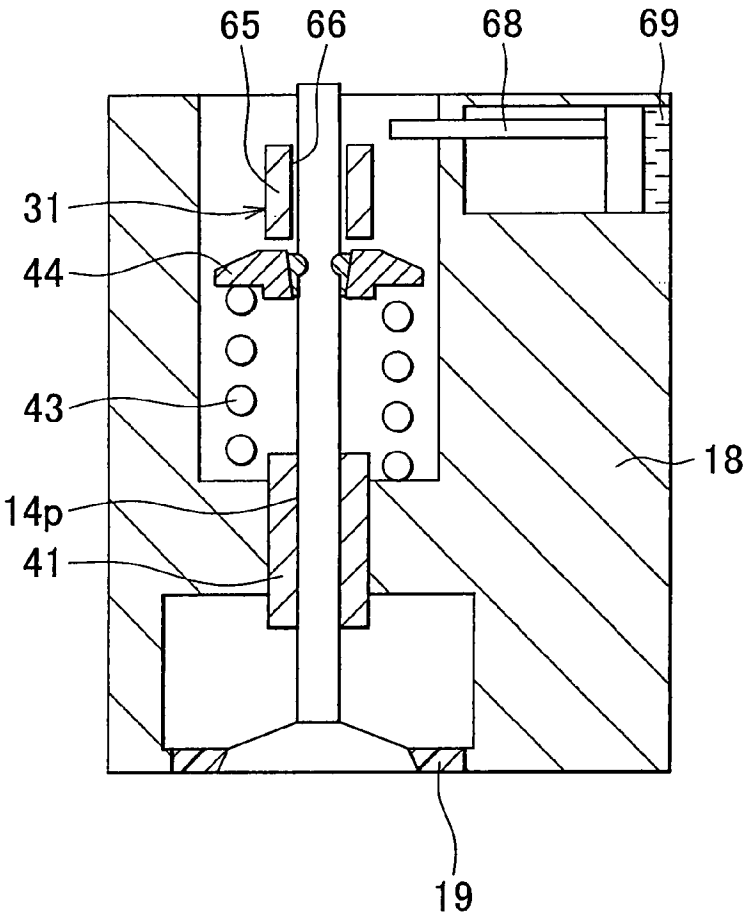
FIGS. 6A and 6B are cross-sectional views showing drive states of the electromagnetically-driven valve in FIG. 5.
Figure 6A:
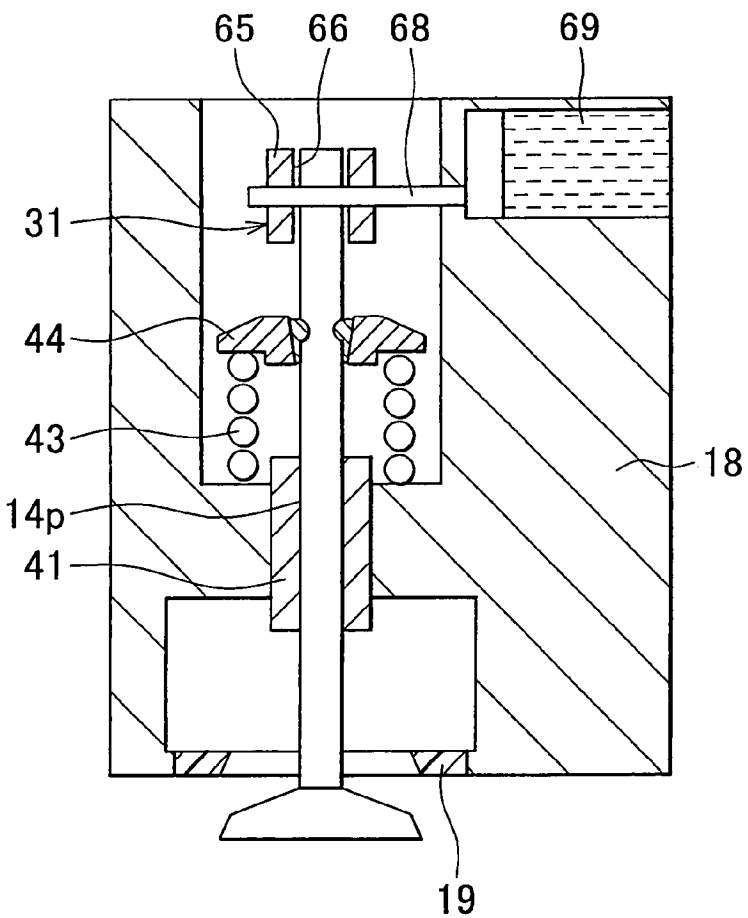

FIG. 5 is a cross-sectional view showing an electromagnetically-driven valve according to a second embodiment of the invention. FIGS. 6A and 6B are cross-sectional views showing drive states of the electromagnetically-driven valve in FIG. 5. The electromagnetically-driven valve according to the second embodiment of the invention has mostly the same structure as that of the electromagnetically-driven valve 10 according to the first embodiment of the invention. The structure common between the first and second embodiments will not be described below.

As shown in FIG. 5 and FIGS. 6A and 6B, the valve plate 31 includes a support portion 65. The support portion 65 movably supports the intake valve 14*q*. The support portion 65 supports the intake valve 14*q* in such a manner that the intake valve 14*q* is allowed to reciprocate. A hole 66 is formed in the support portion 65. The hole 66 is a through-hole. The stem 11*q* of the intake valve 14*q* is fitted into the hole 66. The stem 11*q* is fitted into the hole 66 so as to be slidable in the axial direction.

The electromagnetically-driven valve according to the second embodiment of the invention includes a pin 68, which serves as a fixing member, and a hydraulic cylinder 69, which serves as an actuator that actuates the pin 68. For example, the engine oil within the cylinder head 18 is supplied to the hydraulic cylinder 69.

FIG. 6A describes the state in which the valve plate 31 is kept at the valve-open position in the two-valve drive state. As shown in FIG. 6A, when the hydraulic pressure is supplied to the hydraulic cylinder 69, the pin 68 is fitted into the valve plate 31 and the intake valve 14*q*. Thus, the intake valve 14*q* is fixed to the support portion 65. At this time, the electromagnetically-driven valve is placed in the two-valve drive state in which the intake valve 14*p* and the intake valve 14*q* are both driven.

FIG. 6B shows the state in which the valve plate 31 is kept at the valve-open position in the one-valve drive state. As shown in FIG. 6B, when the supply of hydraulic pressure to the hydraulic cylinder 69 is stopped, the pin 68 moves to the position at which the pin 68 retracts from the valve plate 31 and the intake valve 14*q*. Thus, the fixation of the intake valve 14*q* to the support portion 65 by the pin 68 is cancelled. The intake valve 14*q* is then free from the pivot motion of the disk 21 and stops at the valve-closed position due to the elastic force of the lower spring 43. The valve plate 31 reciprocates while causing the support portion 65 to slide over the stem 11*q*. As a result, the electromagnetically-driven valve is placed in the one-valve drive state in which only the intake valve 14*p* is driven.

Note that, devices other than the hydraulic cylinders may be used as the actuators that drive the pin 68. For example, air cylinders or an electric motor may be used as the actuator. The fixing member that fixes the intake valve 14*q* to the support portion 65 is not limited to a pin-shaped member. For example, a friction plate that uses friction engagement to fix the intake valve 14*q* to the support portion 65 may be used as the fixing member.

With the thus structured electromagnetically-driven valve according the second embodiment of the invention, it is possible to produce mostly the same effects as those in the first embodiment of the invention.

Third Embodiment of the Invention

Figure 7:
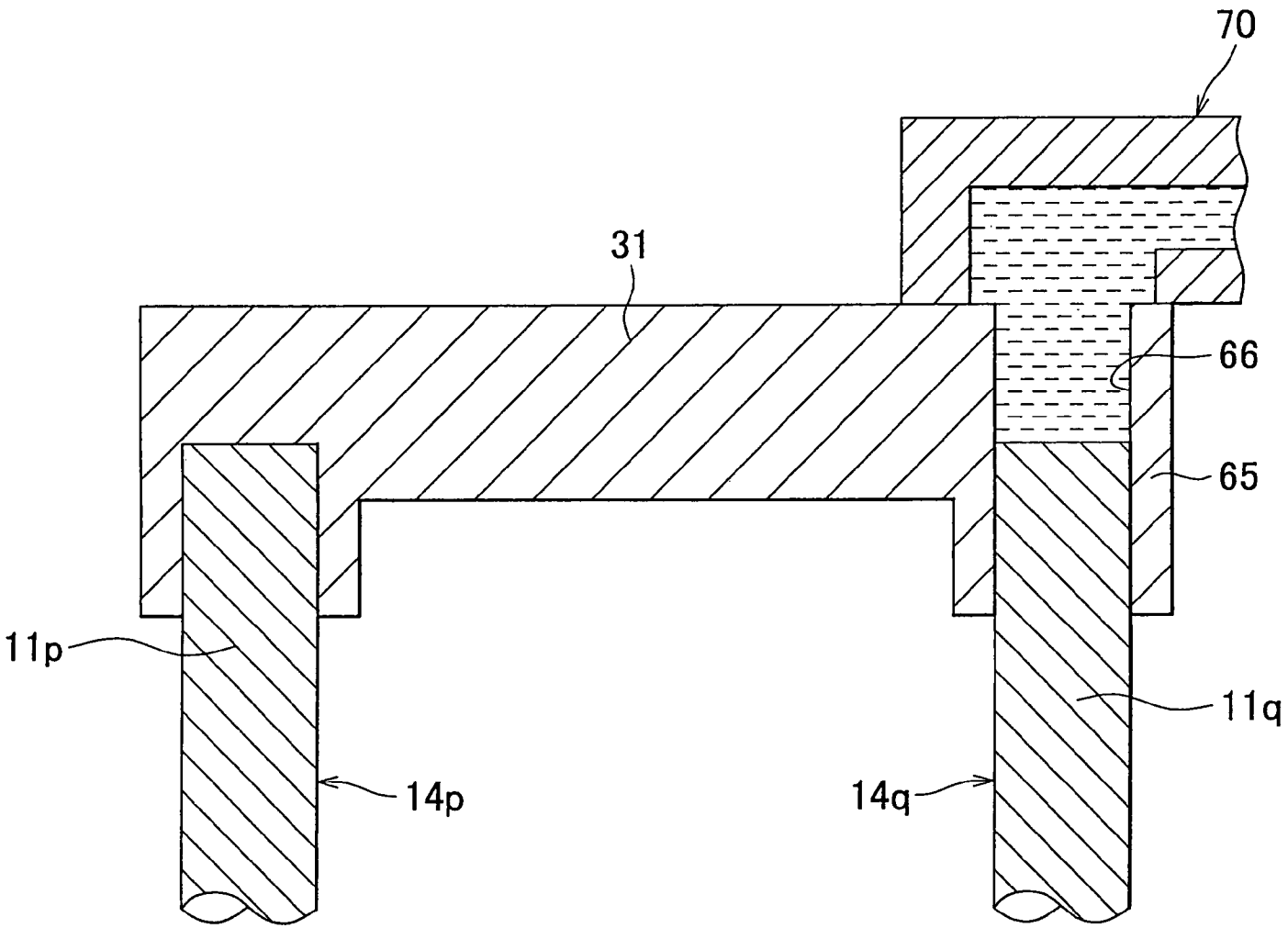
FIG. 7 is a cross-sectional view showing an electromagnetically-driven valve according to a third embodiment of the invention.
Figure 8B:
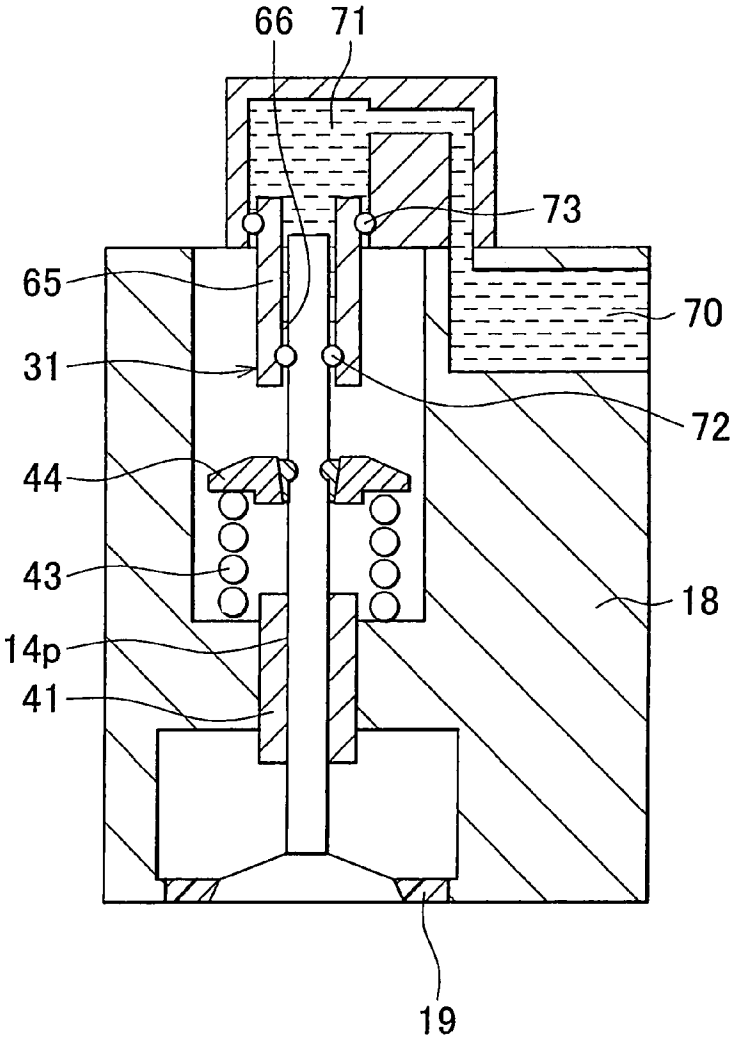
FIGS. 8A and 8B are cross-sectional views showing drive states of the electromagnetically-driven valve in FIG. 7.
Figure 8A:
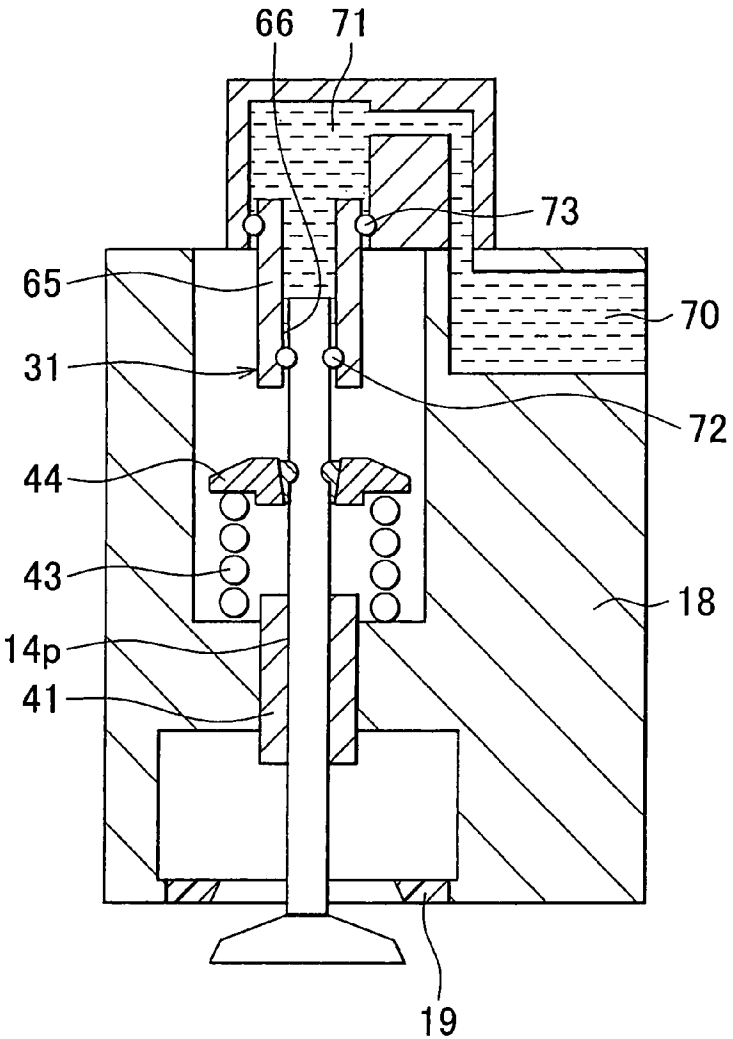

FIG. 7 is a cross-sectional view showing an electromagnetically-driven valve according to a third embodiment of the invention. FIGS. 8A and 8B are cross-sectional views showing drive states of the electromagnetically-driven valve in FIG. 7. The electromagnetically-driven valve according to the third embodiment of the invention has mostly the same structure as that of the electromagnetically-driven valve 10 according to the first embodiment of the invention. The structure common between the first and third embodiments will not be described below.

As shown in FIG. 7, according to the third embodiment of the invention, the valve plate 31 includes the support portion 65. The support portion 65 has mostly the same structure as that of the support portion 65 according to the second embodiment of the invention. The electromagnetically-driven valve according to the third embodiment of the invention includes a hydraulic mechanism 70. The hydraulic mechanism 70 applies hydraulic pressure to the intake valve 14*q* to fix the intake valve 14*q* to the support portion 65. Namely, the hydraulic pressure that is applied to the intake valve 14*q* by the hydraulic mechanism 70 has a function similar to that of the pin 68 according to the second embodiment of the invention.

The hydraulic mechanism 70 includes a hydraulic chamber 71. The oil for applying hydraulic pressure to the intake valve 14*q* is supplied to the hydraulic chamber 71. The support portion 65 is fitted into the hydraulic chamber 71 in such a manner that the support portion 65 slides in the direction in which the valve plate 31 reciprocates. An O-ring 72, which serves as a seal member, is arranged between the stem 11*q* and the support portion 65. Similarly, an O-ring 73, which serves as a seal member, is arranged between the support portion 65 and the inner wall of the hydraulic chamber 71. With this structure, leakage of oil from the hydraulic chamber 71 is prevented.

FIG. 8A shows the state in which the valve plate 31 is kept at the valve-open position in the two-valve drive state. As shown in FIG. 8A, when the hydraulic pressure is applied to the intake valve 14*q* by the hydraulic mechanism 70, the position of the intake valve 14*q* with respect to the support portion 65 is fixed. The valve plate 31 reciprocates the intake valves 14*p* and 14*q* while sliding over the inner wall of the hydraulic chamber 71. At this time, the electromagnetically-driven valve is placed in the two-valve drive state in which the intake valve 14*p* and the intake valve 14*q* are both driven.

FIG. 8B shows the state in which the valve plate 31 is kept at the valve-open position in the one-valve drive state. As shown in FIG. 8B, when the supply of hydraulic pressure to the hydraulic mechanism 70 is stopped, the intake valve 14*q* is kept at the valve-closed position due to the elastic force of the coil spring 43. The valve plate 31 reciprocates the intake valve 14*p* while sliding over the inner wall of the hydraulic chamber 71 and the stem 11*q* of the intake valve 14*q*. At this time, the electromagnetically-driven valve is placed in the one-valve drive state in which only the intake valve 14*p* is driven.

With the thus structured electromagnetically-driven valve according to the third embodiment of the invention, it is possible to produce mostly the same effects as those in the first embodiment of the invention.

Figure 9:
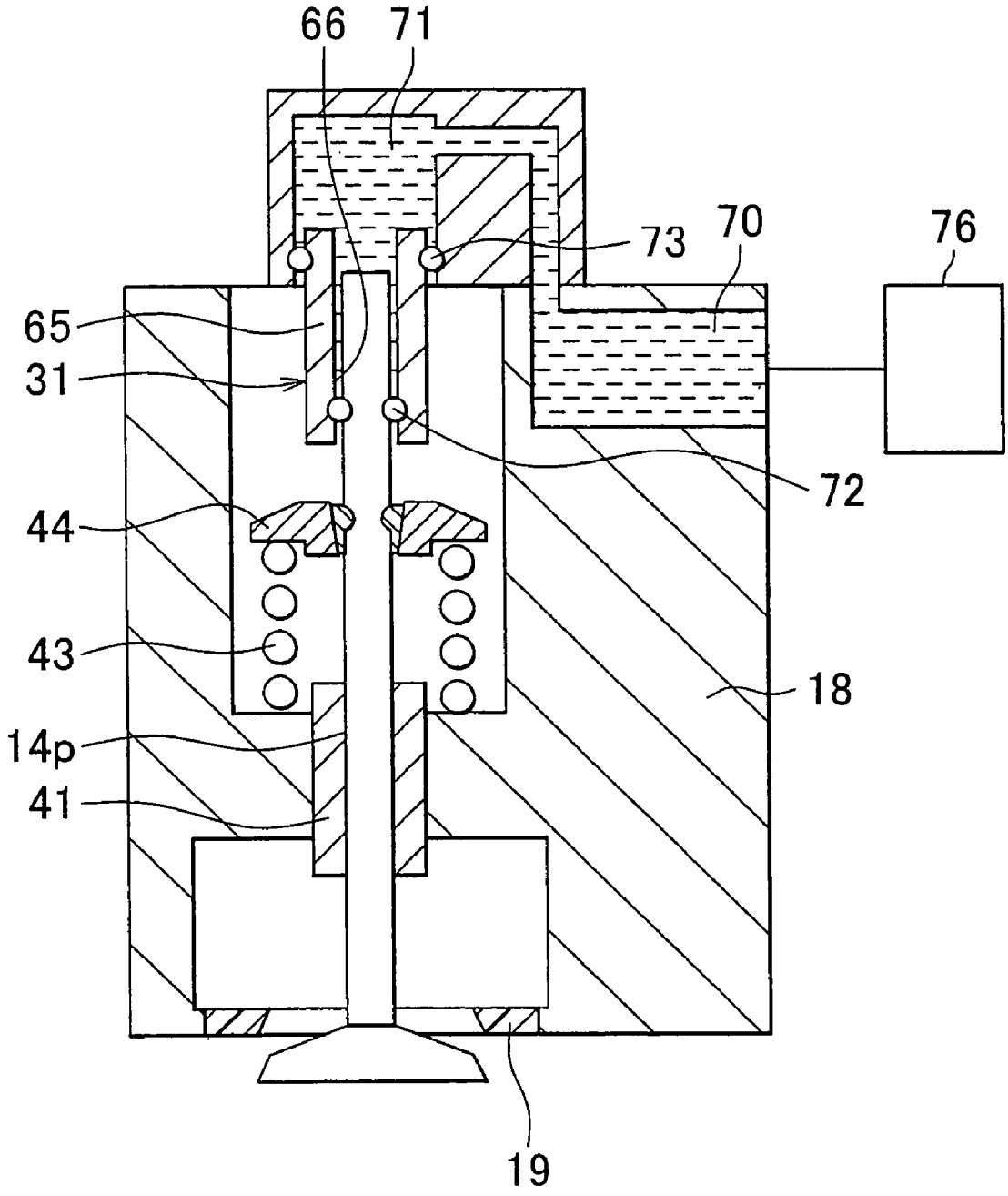
FIG. 9 is a cross-sectional view showing a modification of the electromagnetically-driven valve in FIG. 7.

FIG. 9 is a cross-sectional view showing a modification of the electromagnetically-driven valve in FIG. 7. FIG. 9 shows the state in which the valve plate 31 is kept at the valve-open position in the two-valve drive state.

As shown in FIG. 9, in this modification, the hydraulic mechanism 70 includes a hydraulic pressure control unit 76. The hydraulic pressure control unit 76 controls the degree of hydraulic pressure that is applied to the intake valve 14*q* by the hydraulic mechanism 70. With this structure, the position at which the intake valve 14*q* is fixed to the support portion 65 may be adjusted, thereby making it possible to change the lift amount of the intake valve 14*q*. For example, as shown in FIG. 9, the lift amount of the intake valve 14*q* is reduced by setting the degree of hydraulic pressure that is applied to the intake valve 14*q* to a smaller value.

The hydraulic mechanism 70 that includes the hydraulic pressure control unit 76 may be provided to each of the intake valves 14*p* and 14*q*. In this case, it is possible to change the lift amount of the intake valve 14*p* and the lift amount of the intake valve 14*q*, thereby increasing the flexibility of change in the lift amounts.

The structure of an electromagnetically-driven valve to which the invention is applied is not limited to the structures described above. For example, a structure in which an upper disk and a lower disk are arranged above and below an electromagnet, respectively, and an intermediate stem is connected to these disks may be employed. An electromagnetically-driven valve to which the invention is applied is not limited to a pivot type. The invention may be applied to, for example, a translational type electromagnetically-driven valve that drives a valve using a liner motion achieved by electromagnetic force.

Thus, the embodiments of the invention that have been disclosed in the specification are to be considered in all respects as illustrative and not restrictive. The technical scope of the invention is defined by claims, and all changes which come within the meaning and range of equivalency of the claims are therefore intended to be embraced therein.

What is claimed is:

1. An electromagnetically-driven valve, comprising:

a first valve and a second valve that are provided in an internal combustion engine, and that are arranged side by side;

a connection member that connects the first valve with the second valve, wherein driving force that is generated by electromagnetic force is transferred to the connection member; and a changing mechanism that is fitted to the connection member, and that changes a valve drive state between a first state, in which the first valve and the second valve are both driven, and a second state, in which the first valve is driven and the second valve is stopped, wherein, in the second state, relative movement between the connection member and the second valve is allowed so that the driving force that is transferred to the connection member is prevented from being transferred to the second valve.

2. The electromagnetically-driven valve according to claim 1, wherein:

the connection member includes a first connection portion that is connected to the first valve and a second connection portion that is connected to the second valve;

the changing mechanism includes an actuator that actuates the connection member; and when the changing mechanism changes the valve drive state from the first state to the second state, the actuator causes the connection member to pivot about the first connection portion to thereby disconnect the second valve from the second connection portion.

3. The electromagnetically-driven valve according to claim 1, wherein:

the connection member includes a support portion that movably supports the second valve;

the changing mechanism includes a fixing member that fixes the second valve to the support portion, and an actuator that actuates the fixing member; and when the changing mechanism changes the valve drive state from the first state to the second state, the actuator actuates the fixing member to cancel fixation of the second valve to the support portion by the fixing member, to thereby allow the support portion to move relative to the second valve.

4. The electromagnetically-driven valve according to claim 1, wherein:

the connection member includes a support portion that movably supports the second valve;

the changing mechanism includes a hydraulic mechanism that applies hydraulic pressure to the second valve to fix the second valve to the support portion; and when the changing mechanism changes the valve drive state from the first state to the second state, fixation of the second valve to the support portion by the hydraulic mechanism is cancelled to thereby allow the support portion to move relative to the second valve.

5. The electromagnetically-driven valve according to claim 4, wherein the hydraulic mechanism includes a hydraulic pressure control unit that controls a degree of hydraulic pressure that is applied to the second valve.

6. An electromagnetically-driven valve according to claim 1, comprising:

a first valve and a second valve that are provided in an internal combustion engine, and that are arranged side by side;

a connection member that connects the first valve with the second valve, wherein driving force that is generated by electromagnetic force is transferred to the connection member; and a changing mechanism that is fitted to the connection member, and that changes a valve drive state between a first state, in which the first valve and the second valve are both driven, and a second state, in which the first valve is driven and the second valve is stopped, wherein both the first valve and the second valve are intake valves or exhaust valves of the internal combustion engine.

* * * * *

UNITED STATES PATENT AND TRADEMARK OFFICE

CERTIFICATE OF CORRECTION

PATENT NO. : 7,913,655 B2
APPLICATION NO. : 12/155607
DATED : March 29, 2011
INVENTOR(S) : Yutaka Sugie et al.

It is certified that error appears in the above-identified patent and that said Letters Patent is hereby corrected as shown below:

| Column | Line | |
|---|---|---|
| 5 | 20 | Change "electromagnet **5** in may" to --electromagnet **51***n* may--. |
| 5 | 42 | Change "stems **11***p* and **1** *q*" to --stems **11***p* and **11***q*--. |
| 5 | 54 | Change "electromagnet **5** in," to --electromagnet **51***n*,--. |
| 5 | 56 | Change "electromagnet **5** in" to --electromagnet **51***n*--. |
| 6 | 15 | Change "intake valve **14***c*" to --intake valve **14***q*--. |
| 10 | 45-46 | After "valve" delete "according to claim **1**". |

Signed and Sealed this
Sixteenth Day of August, 2011

David J. Kappos

David J. Kappos
*Director of the United States Patent and Trademark Office*